US006350156B1

(12) United States Patent
Hasircoglu et al.

(10) Patent No.: US 6,350,156 B1
(45) Date of Patent: Feb. 26, 2002

(54) MODULAR JACK WITH DEFLECTABLE PLUG-BLOCKING MEMBER

(75) Inventors: Alexander W. Hasircoglu, Columbia; Daniel R. Ringler, Elizabethville, both of PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 09/556,531

(22) Filed: Apr. 24, 2000

(51) Int. Cl.[7] ..... H01R 24/00
(52) U.S. Cl. ..... 439/676; 439/677
(58) Field of Search ..... 439/676, 677, 439/680, 344

(56) References Cited

U.S. PATENT DOCUMENTS 3,736,547 A 5/1973 Koenig ..... 439/93
4,969,836 A 11/1990 Magnier et al. ..... 439/188
5,096,441 A 3/1992 Jaag ..... 439/676
5,244,402 A 9/1993 Pasterchick, Jr. et al. ... 439/217
6,186,835 B1 * 6/1999 Cheshire ..... 439/676

* cited by examiner

*Primary Examiner*—Neil Abrams
*Assistant Examiner*—Javaid Nasri

(57) ABSTRACT

A modular jack for receiving an RJ-45 plug and for blocking insertion of an RJ-11 plug is disclosed. The modular jack has stamped and formed deflection members having retention sections, ramp surfaces and blocking tabs extending from ends of the ramp surfaces. The blocking tabs project laterally inwardly toward the plug-receiving cavity and block an RJ-11 plug from being inserted into the modular jack. An RJ-45 plug is wider than the RJ-11 plug and engages the ramp surfaces of the deflection members to deflect the blocking tabs away from the plug-receiving cavity, thereby allowing insertion of the RJ-45 plug.

22 Claims, 13 Drawing Sheets

MODULAR JACK WITH DEFLECTABLE PLUG-BLOCKING MEMBER

FIELD OF THE INVENTION

The present invention relates to receptacle connectors for modular plugs. In particular, the invention is directed toward a receptacle connector having a deflectable blocking member for selectively receiving a specific sized modular plug.

BACKGROUND OF THE INVENTION

Modular jacks which receive RJ-11 and RJ-45 type modular plugs are well known in the communications and computer industries. Often, communications and computer equipment are outfitted with both RJ-11 and RJ-45 modular jacks. Of course, each of these RJ-11 or RJ-45 modular jacks are intended to receive only an RJ-11 or RJ-45 plug, respectively. However, frequently placement of the modular jacks within electronic equipment is in a location which does not lend itself to easy visual inspection. For instance, desk top computers commonly have input/output connectors placed on a rear panel of the computer chassis. As such, often RJ-11 and RJ-45 modular jacks are located side by side on the rear of a piece of electronic equipment or in another limited access area. Both aesthetics and system architecture dictate placement of modular jacks and, therefore, selection of their location is a limited option.

Since access to the modular jacks on a piece of electronic equipment is often restricted, insertion of a modular plug into a modular jack is frequently performed without visual verification. Thus, it is possible that during blind installation of a modular plug into a modular jack, an equipment operator may incorrectly align an RJ-45 plug with an RJ-11 jack or an RJ-11 plug with an RJ-45 jack. Misaligning an RJ-45 plug with an RJ-11 jack is of little concern because an operator will quickly notice that the RJ-45 plug is larger than the plug receiving cavity of an RJ-11 jack. In fact, due to the size differential, engagement of an RJ-45 plug and an RJ-11 jack is impossible. However, misalignment of an RJ-11 plug with an RJ-45 jack creates a serious concern. An RJ-11 plug will fit within an RJ-45 jack, often quite comfortably. In such an event, an operator will actually hear the audible click of the modular plug latch snapping into place within the modular jack and feel what seems to be proper mating of a modular plug within a modular jack. Moreover, the RJ-11 plug will be inserted far enough into the RJ-45 modular jack to allow electrical contacts on the plug to electrically engage electrical contacts of the jack. This can lead to severe damage to the electronic equipment because certain modular plug contacts may be carrying higher current than the electronic equipment circuitry is intended to receive from a respective electrically engaged modular jack contact. For instance, a power line from an RJ-11 plug may improperly become electrically engaged with what was intended to be a signal line within the RJ-45 modular jack.

Furthermore, even if an operator recognizes that an RJ-11 plug was mistakenly inserted into an RJ-45 jack, the RJ-45 jack will likely have sustained permanent damage to the contacts since the RJ-11 plug tends to deform the outer-most RJ-45 contacts, by laterally bending them out of their original position.

SUMMARY OF THE INVENTION

Accordingly, a modular jack is needed that can prevent inadvertent electrical and mechanical engagement of an RJ-11 plug with an RJ-45 jack.

Therefore, a receptacle connector is provided for receiving a mating plug and for blocking a relatively smaller second plug from receipt in the receptacle connector. The receptacle connector comprises a housing having a plug-receiving cavity and terminals mounted therein. A deflection member formed of a metal sheet material having a retention section, a ramp surface and a blocking tab is mounted in the housing. The retention section is mounted in a slot and the ramp surface extends into the plug-receiving cavity such that the blocking tab extends laterally from the ramp surface further into the plug-receiving cavity. When the mating plug is inserted into the plug-receiving cavity, the ramp surface is engaged and the blocking tab deflects away from the mating plug thereby allowing insertion of the mating plug. When the second plug is inserted into the plug-receiving cavity, the second plug is stopped by the blocking tabs, thereby preventing insertion of the second plug.

Additionally, a modular jack is provided for receiving an RJ-45 plug and blocking an RJ-11 plug from insertion into the modular jack. The modular jack comprises a housing having a plug-receiving cavity and terminals mounted in the housing that project into the plug-receiving cavity. Deflection members are provided on each side of the plug-receiving cavity. Each deflection member has a retention section and a ramp surface arcuately joined. A blocking tab extends transversely from an end of the ramp surface. The retention sections are held in slots of the housing such that the ramp surfaces extend toward the plug-receiving cavity and the blocking tabs are opposed and extend inwardly toward the plug-receiving cavity. The ramp surfaces are disposed such that when the RJ-45 plug is inserted into the plug-receiving cavity, a leading edge of the RJ-45 plug deflects the ramp surface and the blocking tab away from the plug-receiving cavity. Upon insertion of the RJ-11 plug, a leading edge of the RJ-11 plug strikes the blocking tab, thereby preventing insertion thereof.

BRIEF DESCRIPTION OF THE DRAWINGS

Embodiments of the present invention will now be described by way of example with reference to the following drawings, wherein.

DETAILED DESCRIPTION OF THE INVENTION

Figure 1:
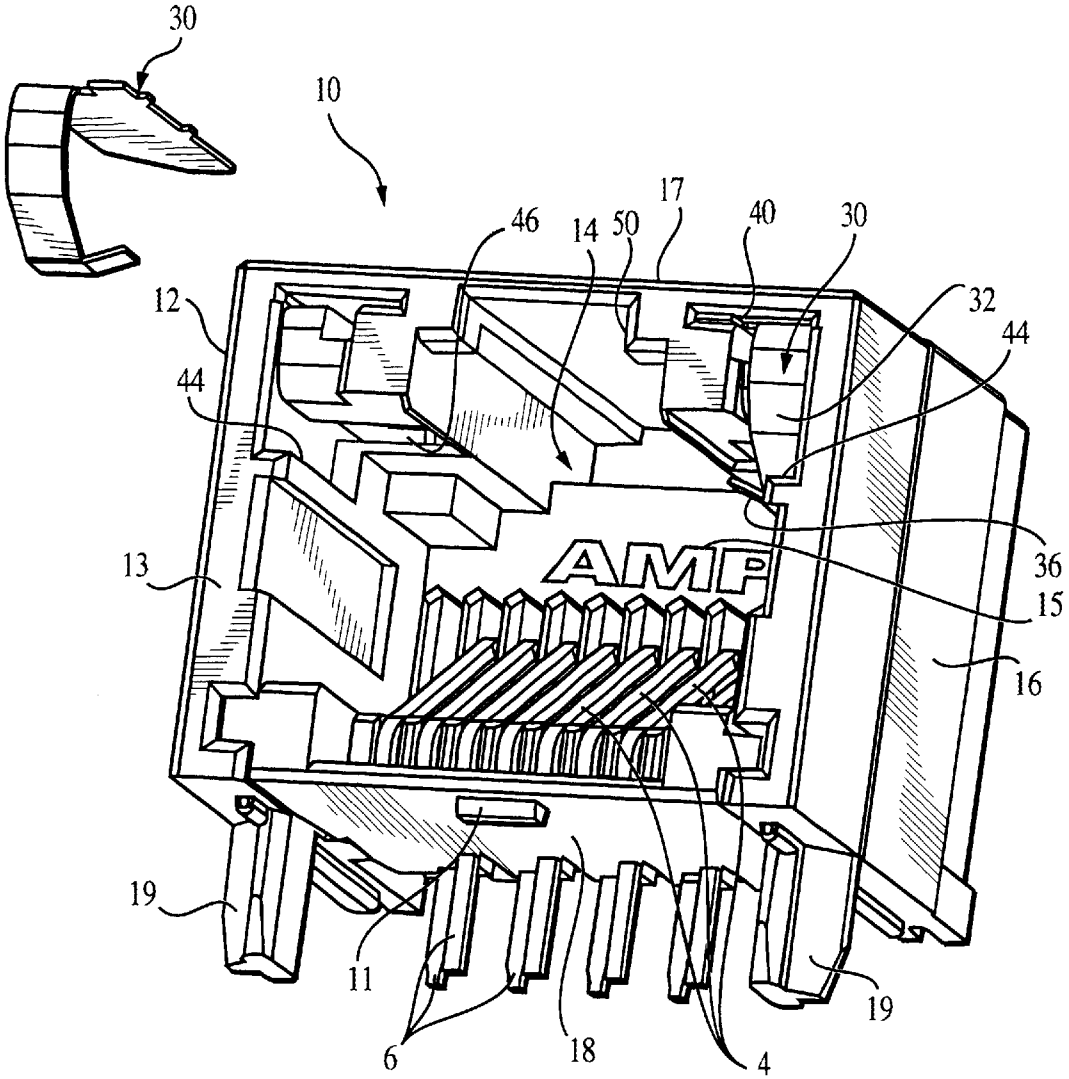
FIG. 1 is an isometric front view of the modular jack of the present invention with a deflection member exploded therefrom.

FIG. 1 shows a modular jack 10 of the present invention. The modular jack has a generally box-shaped housing 12 which provides a plug receiving cavity 14 and which carries a plurality of electrical terminals 4. Electrical terminals 4 extend into cavity 14 and are provided for making electrical contact with a mating plug (not shown). Terminal tails 6 extend from electrical terminals 4 through a bottom wall 18 of housing 12 for connection to external circuitry, such as traces on a printed circuit board.

Figure 2:
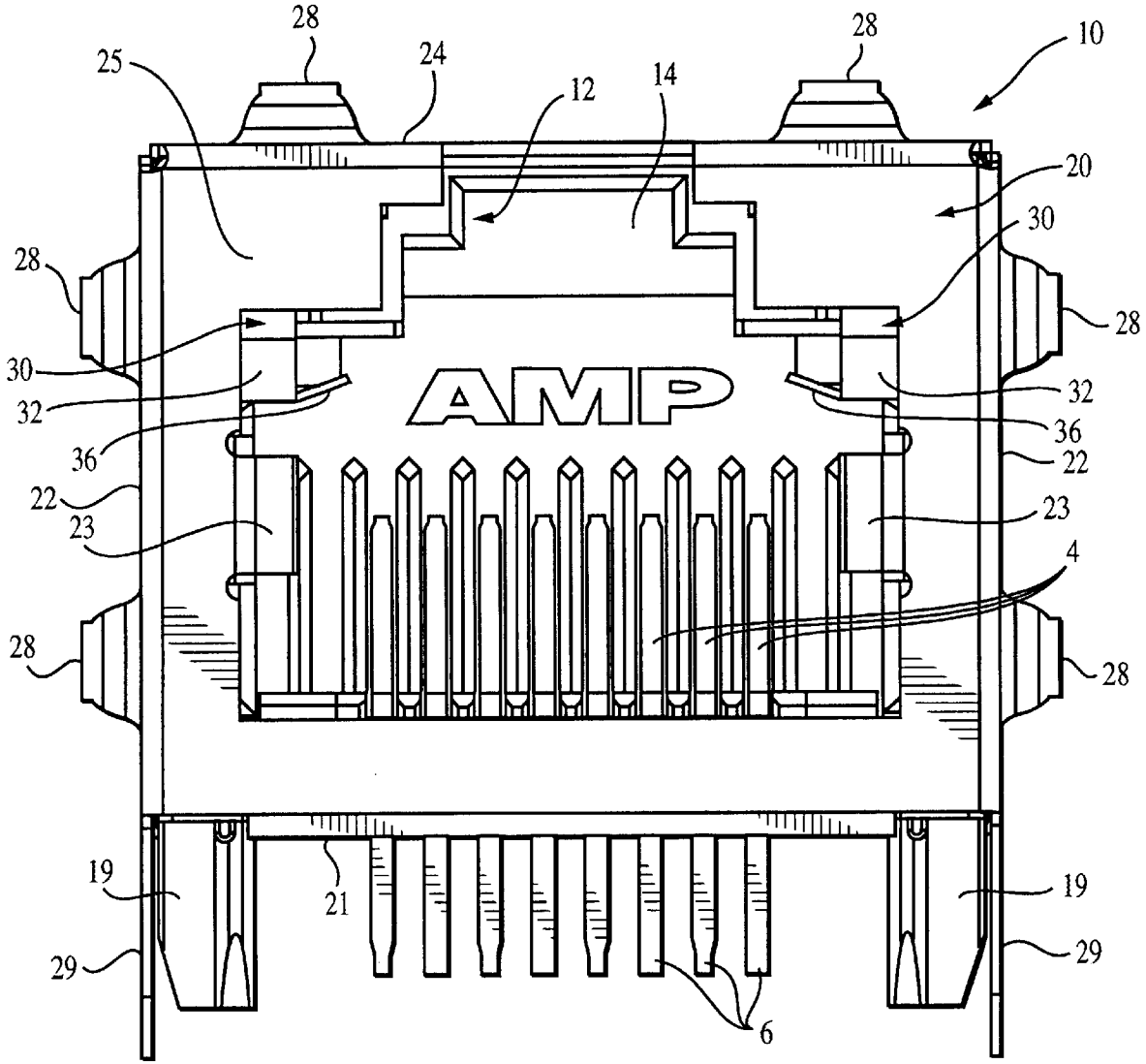
FIG. 2 is a front view of a modular jack of the present invention having a shield member.
Figure 3:
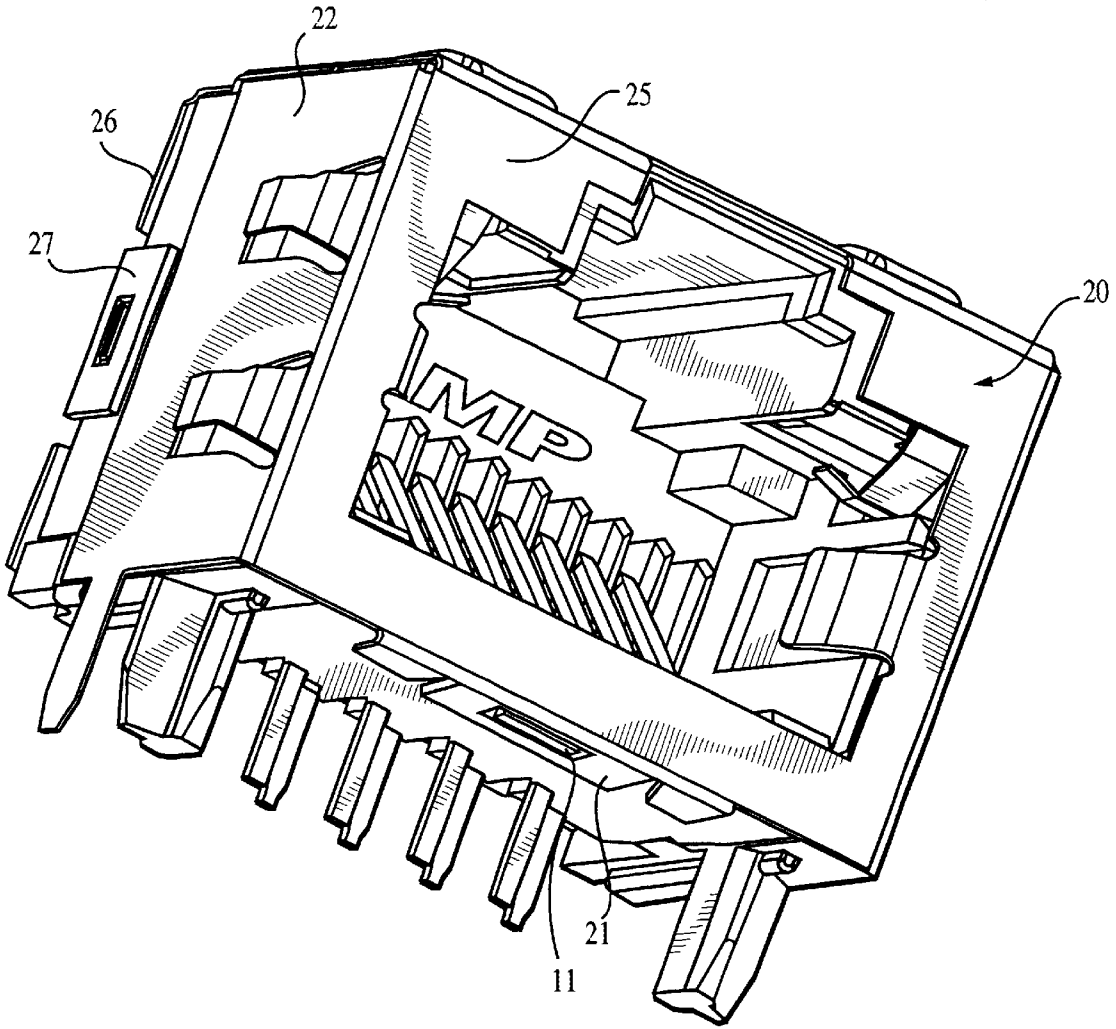
FIG. 3 is an isometric view of the modular jack of FIG. 2.

A shield 20 may optionally be provided for modular jack 10 and is shown in FIGS. 2 and 3. Shield 20 comprises a face plate 25 placed along front face 13 of housing 12. A bottom securing portion 21 is bent from face plate 25 to extend along a forward portion of bottom wall 18 and is secured by lug 11. Sides 22 are also bent from face plate 25 and extend along sidewalls 16 of housing 12. Similarly, a top 24 of shield 20 is bent rearwardly from face plate 25 to extend along top wall 17 of housing 12. Finally, back 26 is bent downwardly from top 24 and is seated against back wall 15 of housing 12. Back 26 is provided with latching tabs 27 which engage projections on sides 22 to secure shield 20 to housing 12. The shield shown in FIGS. 2 and 3 is further provided with shielding posts 29 which extend downwardly from sides 22 and are provided for mounting the modular jack to a circuit board (not shown) and/or connecting the shield to an external ground. Outer tabs 28 are punched from sides 22 and top 24 to provide for panel mounting of modular jack 10. Outer tabs 28 are configured such that modular jack 10 may be inserted into a cut-out of a panel such that outer tabs 28 engage an edge of the cut-out, thereby securing the modular jack within the cut-out and providing a ground path from the shield 20 to the panel (not shown). Inner tabs 23 extend into cavity 14 and further secure the shield 20 to the housing 12 while also improving the snugness of fit of a mating plug (not shown) within the plug receiving cavity 14.

Figure 4:
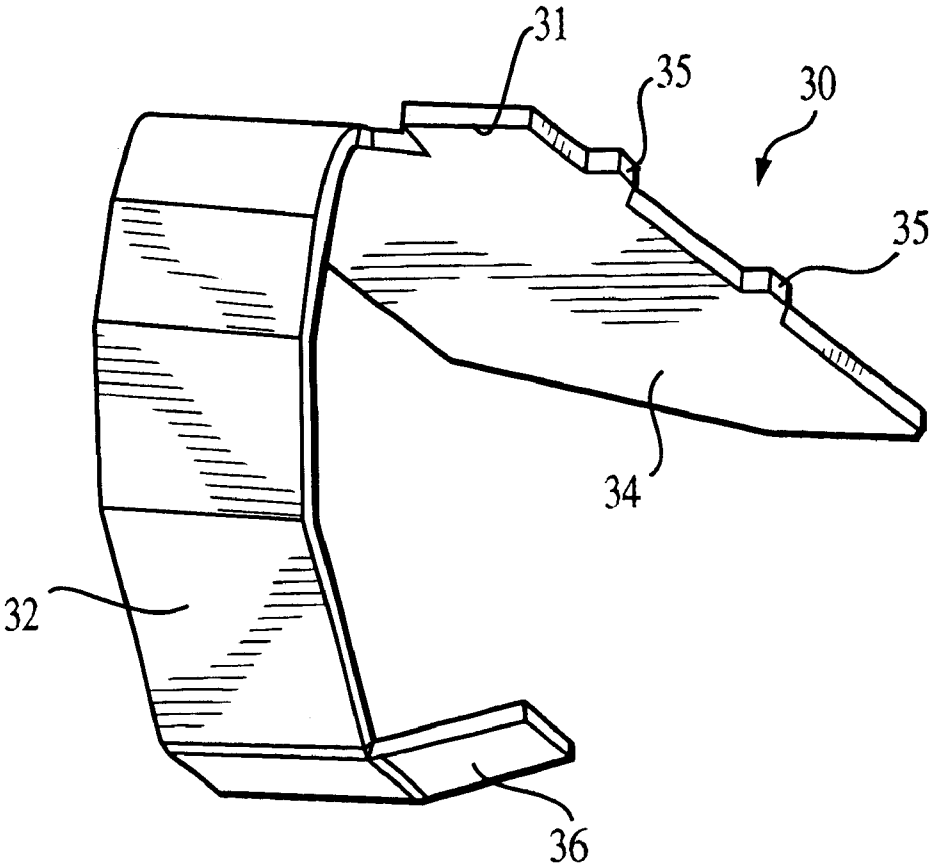
FIG. 4 is an isometric view of a deflection member of the present invention.

Referring back to FIG. 1, a deflection member 30 is provided in housing 12 on either side of plug receiving cavity 14. As further shown in FIG. 4, deflection member 30 may be stamped and formed from a metal sheet material to provide a generally arcuate spring member having a retention end 34, a ramp surface 32 and a stopping tab 36 which projects laterally from an end of ramp surface 32. Retention protrusions 35 may be provided on deflection member 30 to improve retention of deflection member 30 within housing 12. Also, insertion tabs 31 may be provided toward the front of deflection member 30 to create a pushing surface for inserting the deflection member into the housing.

Figure 5:
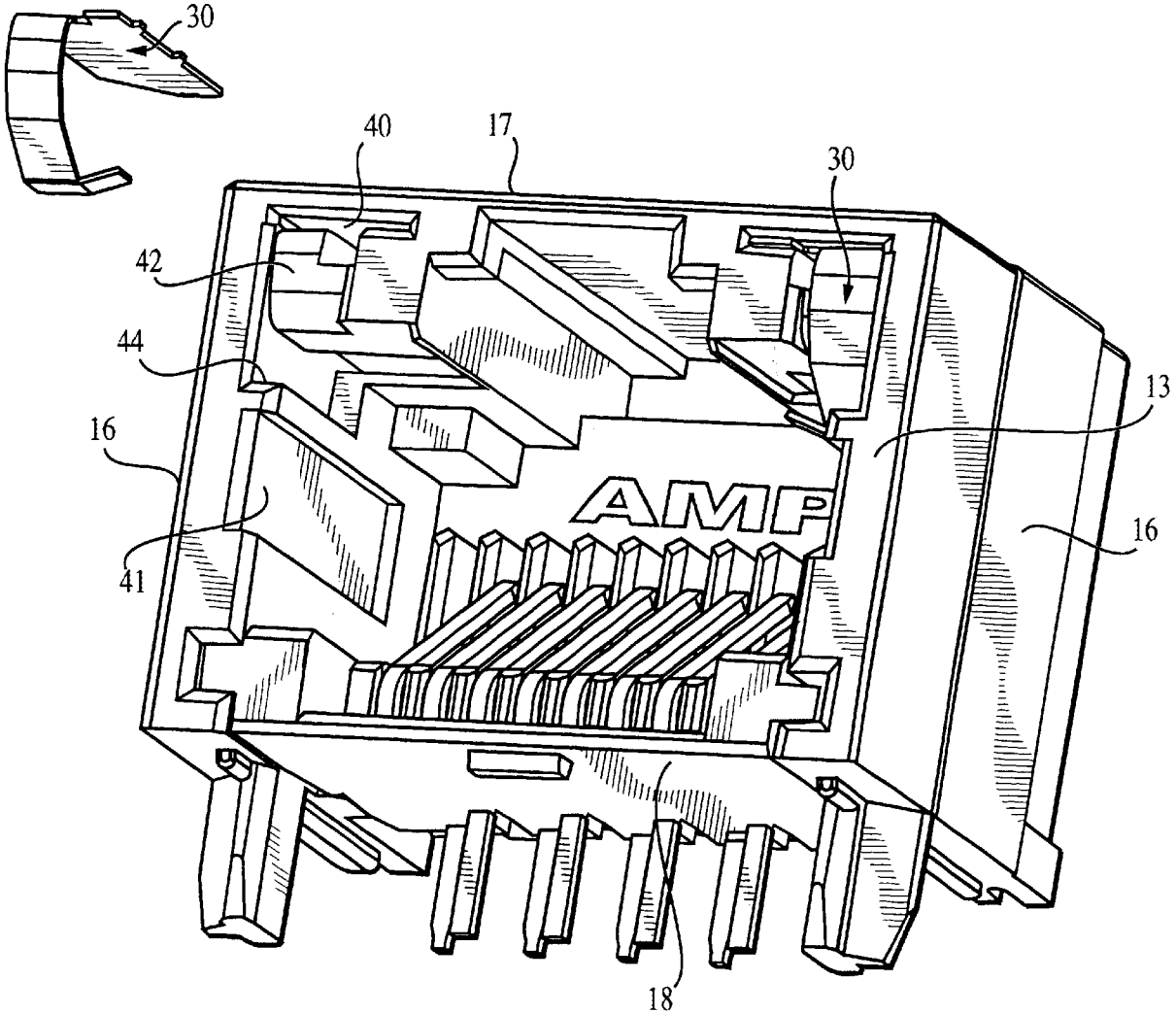
FIG. 5 is an isometric front view of a modular jack of the present invention with a deflection member exploded therefrom.

As shown in FIG. 5, housing 12 is provided with retention slots 40 which extend from an upper portion of front face 13 into housing 12. A shallow 42 is disposed beneath slot 40 and is recessed from front face 13. A ledge 44 is also provided which extends along an interior sidewall 41 of housing 12 and runs from front face 13 into plug receiving cavity 14. Retention slot 40, shallow 42 and ledge 44 define a receiving area for deflection member 30. As shown in FIG. 5, deflection member 30 is loaded into housing 12 from front face 13 such that retention end 34 is inserted into retention slot 40 and the stopping tab end of ramp surface 32 rides along ledge 44 until deflection member 30 becomes fully seated in shallow 42. Insertion tabs 31 provide a pushing surface for inserting deflection member 30 into the housing 12 such that the arcuate spring portion need not be contacted, thereby reducing the likelihood of damage to the deflection member. The deflection members 30 are loaded into the housing 12 such that stopping tabs 36 project inwardly toward plug receiving cavity 14 and are in opposed relationship. Above stopping tabs 36, a recess 46 is provided in housing 12 to accommodate stopping tabs 36 upon deflection.

Figure 6:
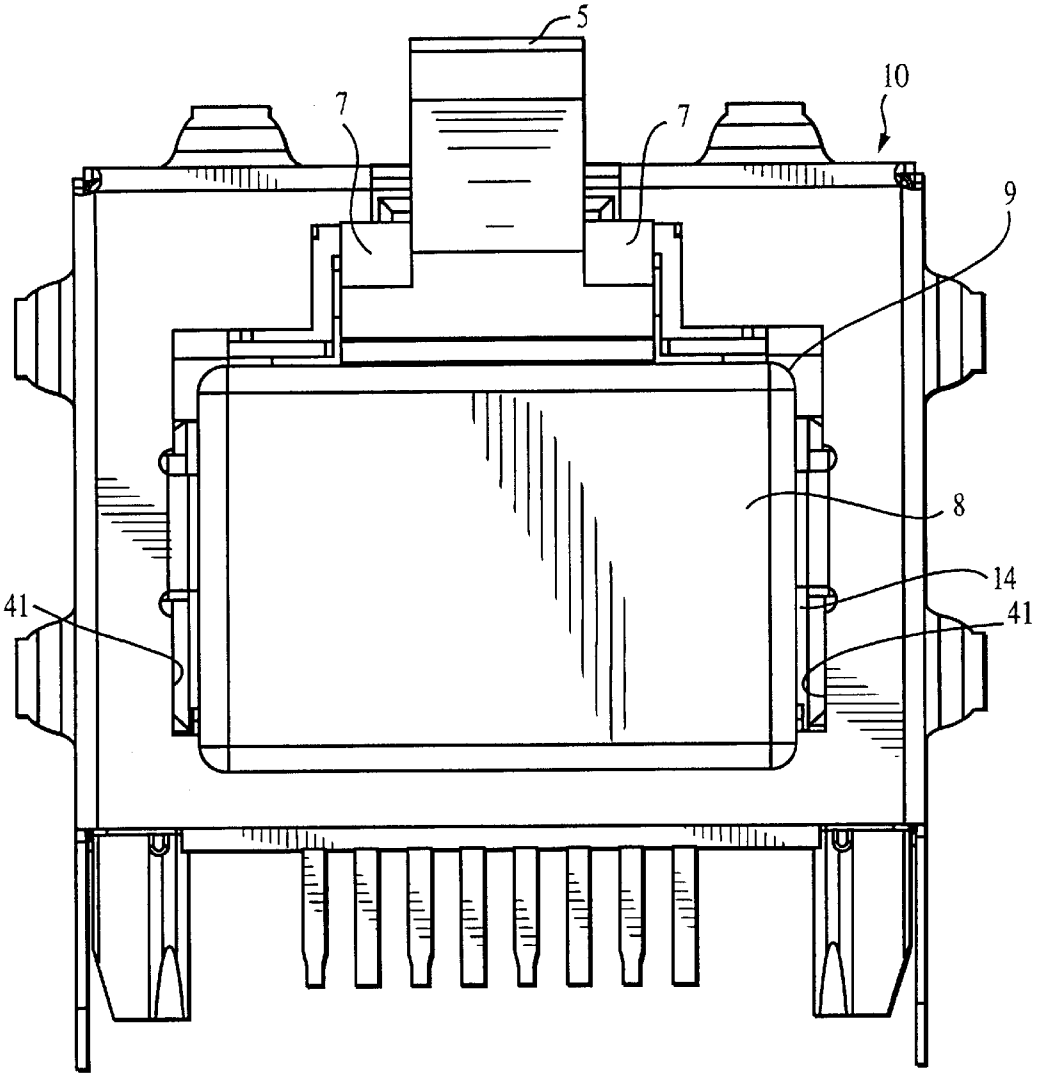
FIG. 6 is a front view of a modular jack of the present invention receiving an RJ-45 type plug.
Figure 7:
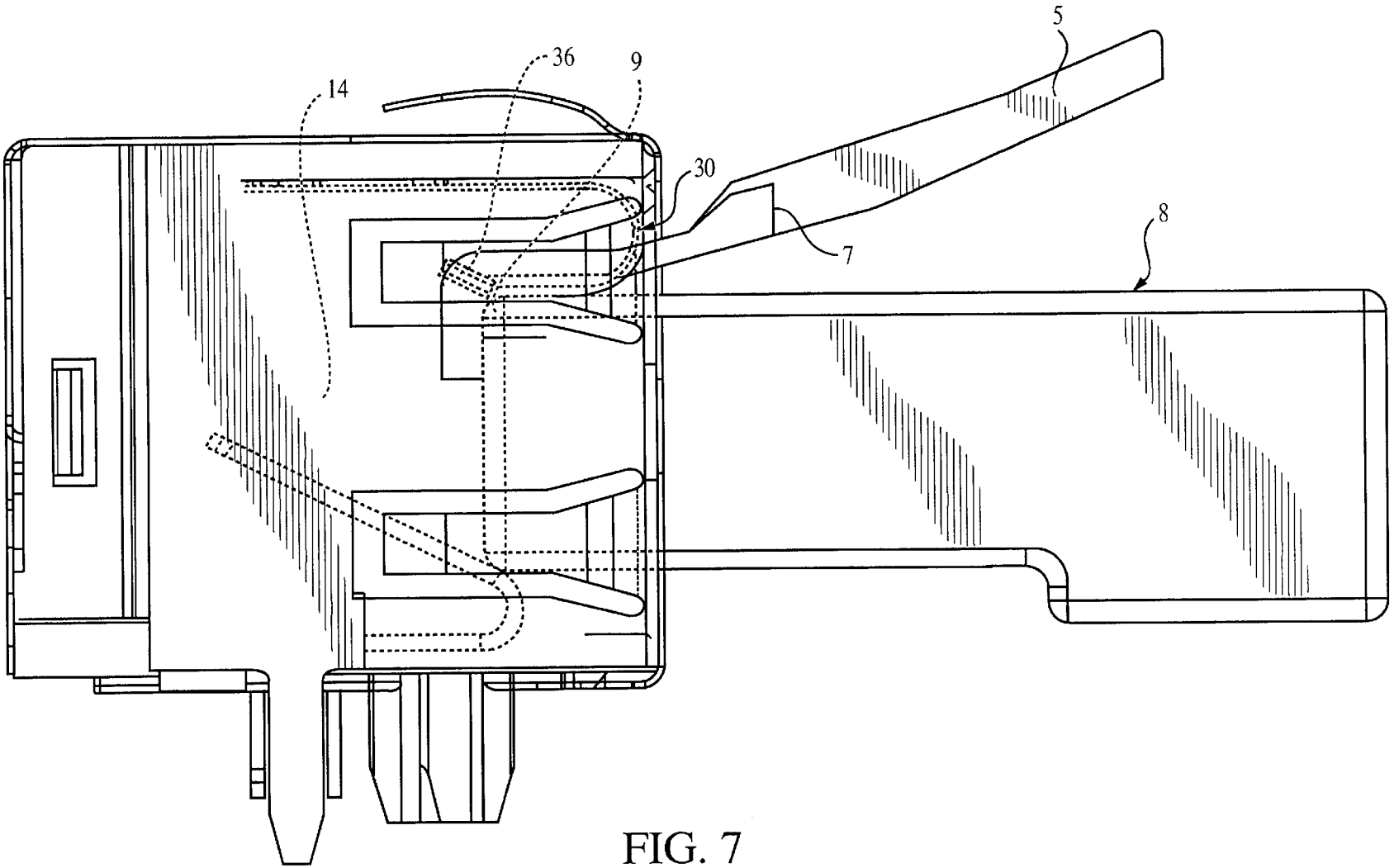
FIG. 7 is a cross-sectional side view of a modular jack of the present invention receiving an RJ-45 type plug.
Figure 8:
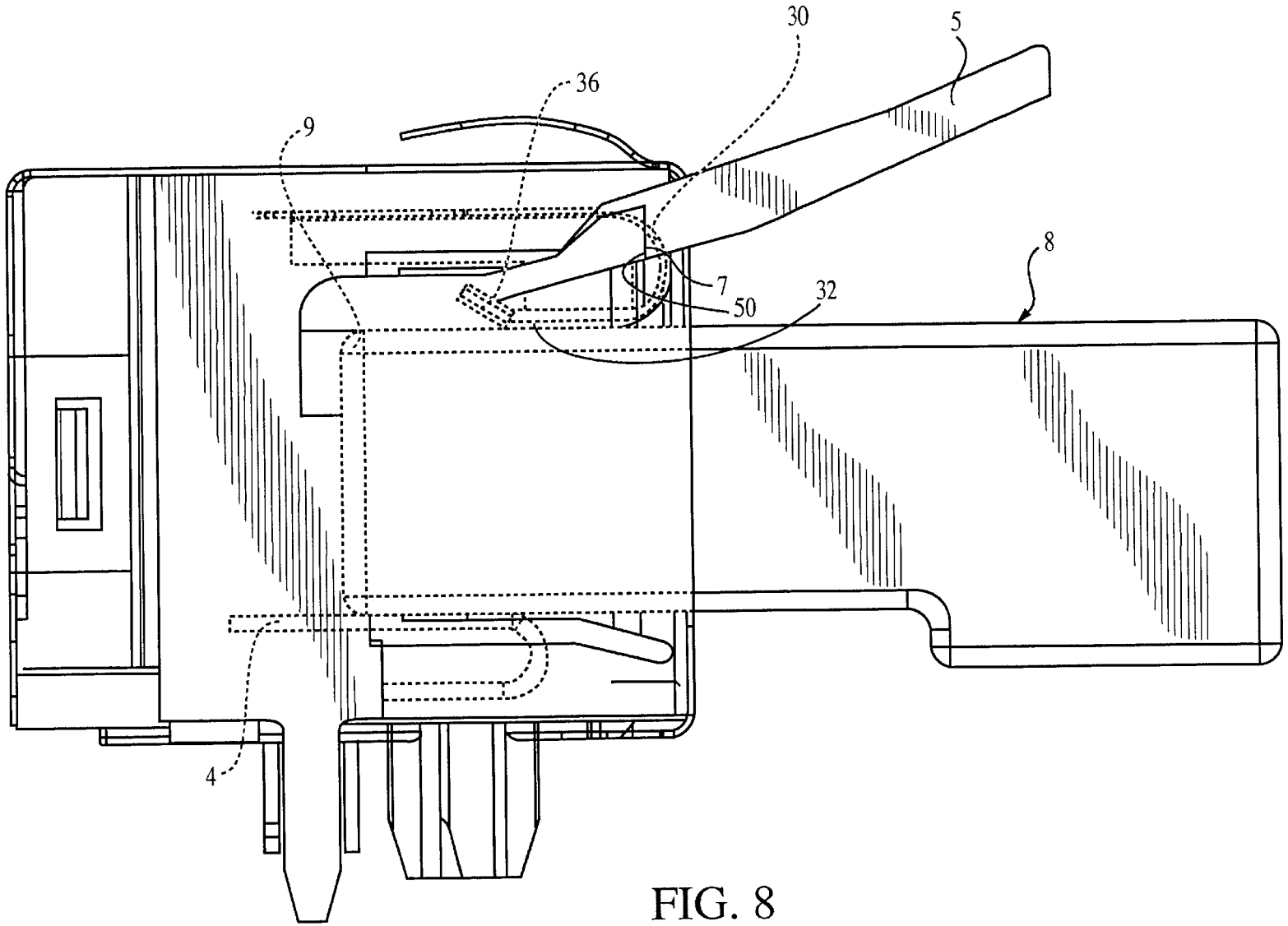
FIG. 8 is a cross-sectional side view of the modular jack of FIG. 7 with an RJ-45 type plug fully inserted.

Operation of the modular jack of the present invention will now be described with reference to FIGS. 6–11. FIG. 6 shows a front view of modular jack 10 as it receives an RJ-45 type modular plug 8. The RJ-45 type plug 8 very nearly fills all of plug receiving cavity 14 and substantially extends from interior sidewall 41 to opposing interior sidewall 41. In other words, the width of plug 8 is adequate to snuggly fit within plug receiving cavity 14. As such, ramp surfaces 32 are engaged by leading edge 9 of plug 8 and are thus deflected upwardly as plug 8 is inserted into plug receiving cavity 14. As shown in FIG. 7, as plug 8 is inserted into plug receiving cavity 14, stopping tabs 36 are deflected upwardly and out of the way of leading edge 9 such that stopping tabs 36 do not interfere with insertion of plug 8 into plug receiving cavity 14. FIG. 8 shows plug 8 fully inserted into plug receiving cavity 14 of modular jack 10 such that deflection member 30 is fully deflected and stopping tabs 36 have been received by recesses 46. Plug latch 5 is shown in a latched position in which latch edges 7 are received behind latching shoulders 50.

Upon removal of plug 8 from modular jack 10, deflection member 30 will resile back to its original form, shown in FIGS. 1–3, such that stopping tabs 36 extend inwardly toward plug receiving cavity 14.

Figure 9:
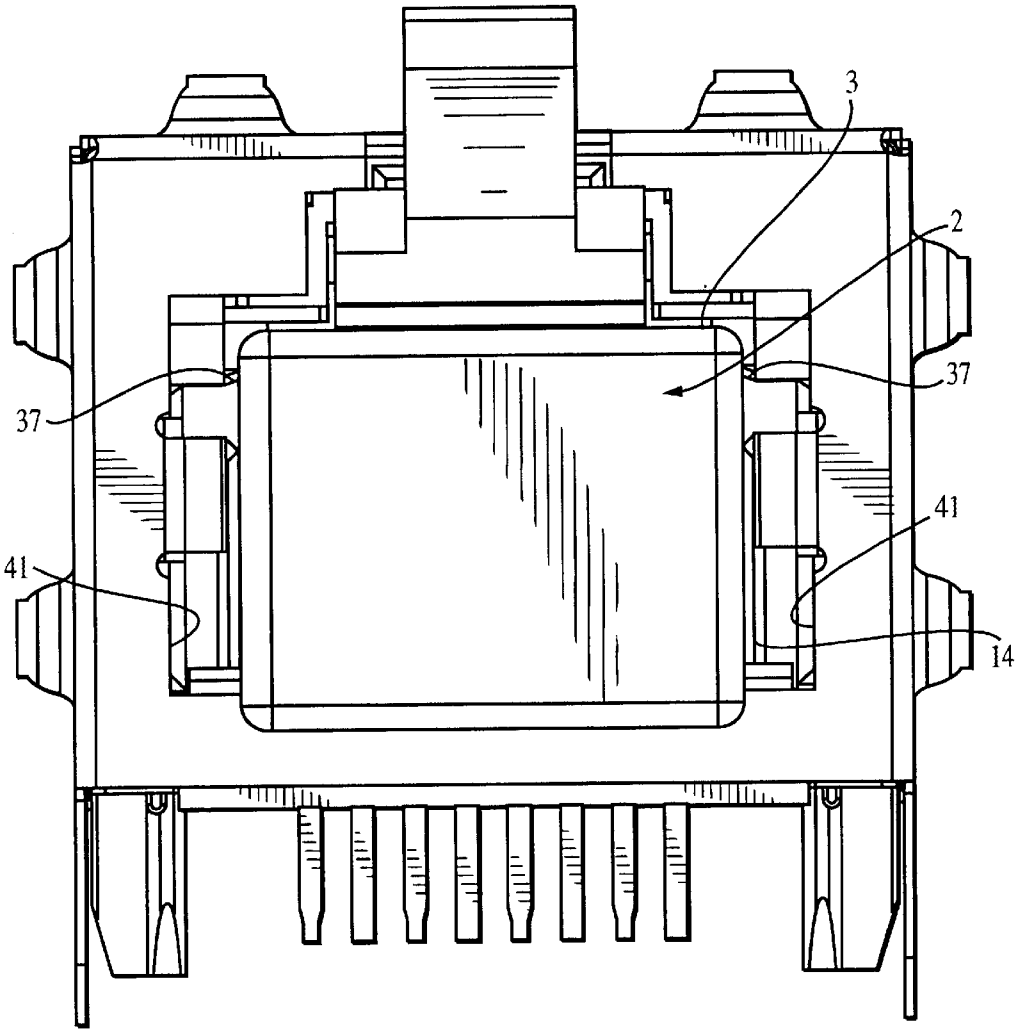
FIG. 9 is a front view of a modular jack of the present invention receiving an RJ-11 type plug.
Figure 10:
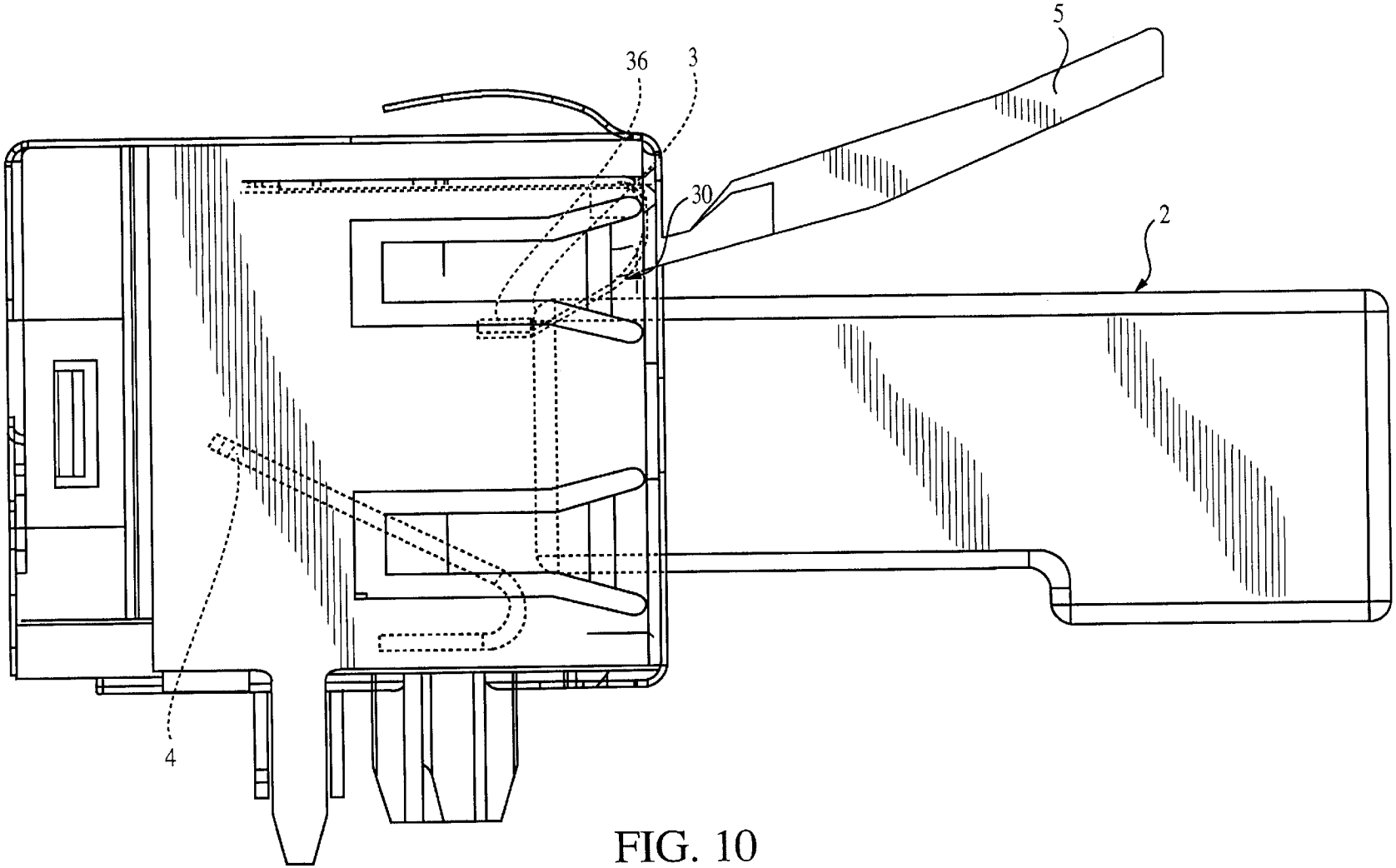
FIG. 10 is a cross-sectional side view of a modular jack of the present invention receiving an RJ-11 type plug.
Figure 11:
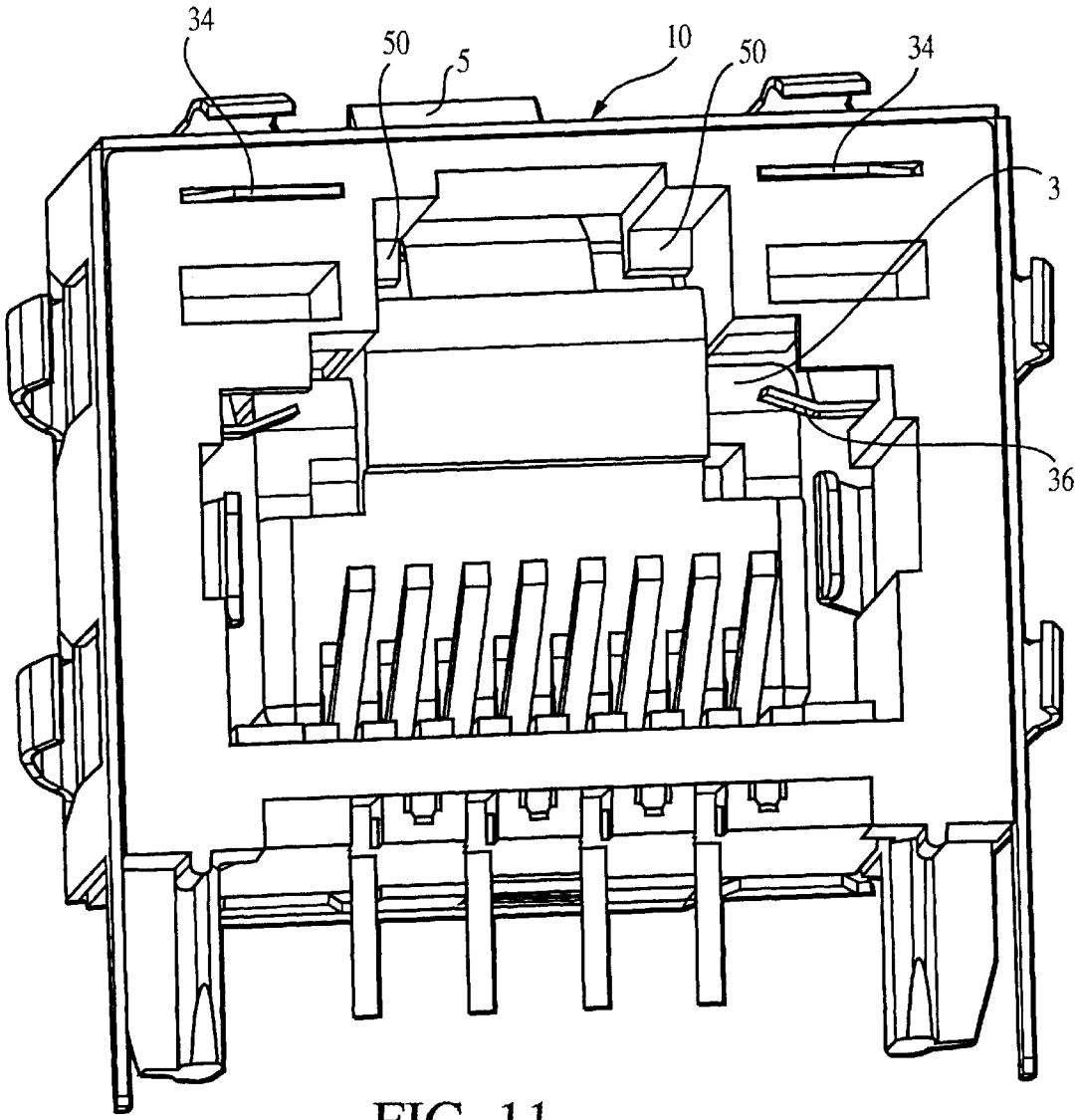
FIG. 11 is a cross-sectional rear view of the modular jack shown in FIG. 10 with an RJ-11 type plug being blocked from insertion.

FIGS. 9–11 show modular jack 10 in operation blocking an RJ-11 type plug 2. FIG. 9 shows an identical view to that shown in FIG. 6 with a RJ-11 type plug 2 substituted for the RJ-45 type plug 8. As shown in FIG. 9, plug 2 does not fully fill plug receiving cavity 14 and does not fully extend from interior sidewall 41 to opposing interior sidewall 41. In other words, because plug 2 is not as wide as plug 8, plug receiving cavity 14 is not entirely filled by plug 2. As such, leading edge 3 of plug 2 does not engage ramp surfaces 32 of deflection member 30. Instead, leading edge 3 passes between ramp surfaces 32 of deflection members 30 and advances into plug receiving cavity 14 until leading edge 3 strikes an edge 37 of stopping tabs 36. Stopping tabs 36 and edges 37 are deliberately positioned within plug receiving cavity 14 sufficiently forward in the housing 12 such that plug 2 strikes stopping tabs 36 prior to engagement with contact terminals 4. Thus, in addition to preventing mechanical engagement, electrical interconnection is also avoided. Furthermore, as shown in FIGS. 10 and 11, plug 2 is stopped by stopping tabs 36 prior to latch 5 engaging latching shoulders 50, thereby preventing locking of the plug 2 within modular jack 10 and providing indication to the user that proper engagement of the plug with the modular jack has not been achieved. Such indication is provided by the conspicuous absence of an audible "click" typically provided by the engagement of latching edges 7 engaging shoulders 50, and an absence of the tactile sensation of such a latching action.

Referring back to FIG. 4, an advantage of the deflection member 30 of the present invention will now be described. As shown, stopping member 36 projects laterally from an end of ramping surface 32 and is preferably canted slightly upwardly so that it is oriented toward the top wall of housing 12 when loaded in the housing. Although this canting of the stopping tabs is not an absolute requirement of the invention, it is preferable in order to avoid interference between the leading edge 9 of plug 8 and edges 37 of stopping tabs 36 during insertion of plug 8 into plug receiving cavity 14. By canting the stopping tabs upwardly, interference between leading edge 9 of plug 8 and edges 37 of stopping tabs 36 is assuredly avoided.

Figure 12:
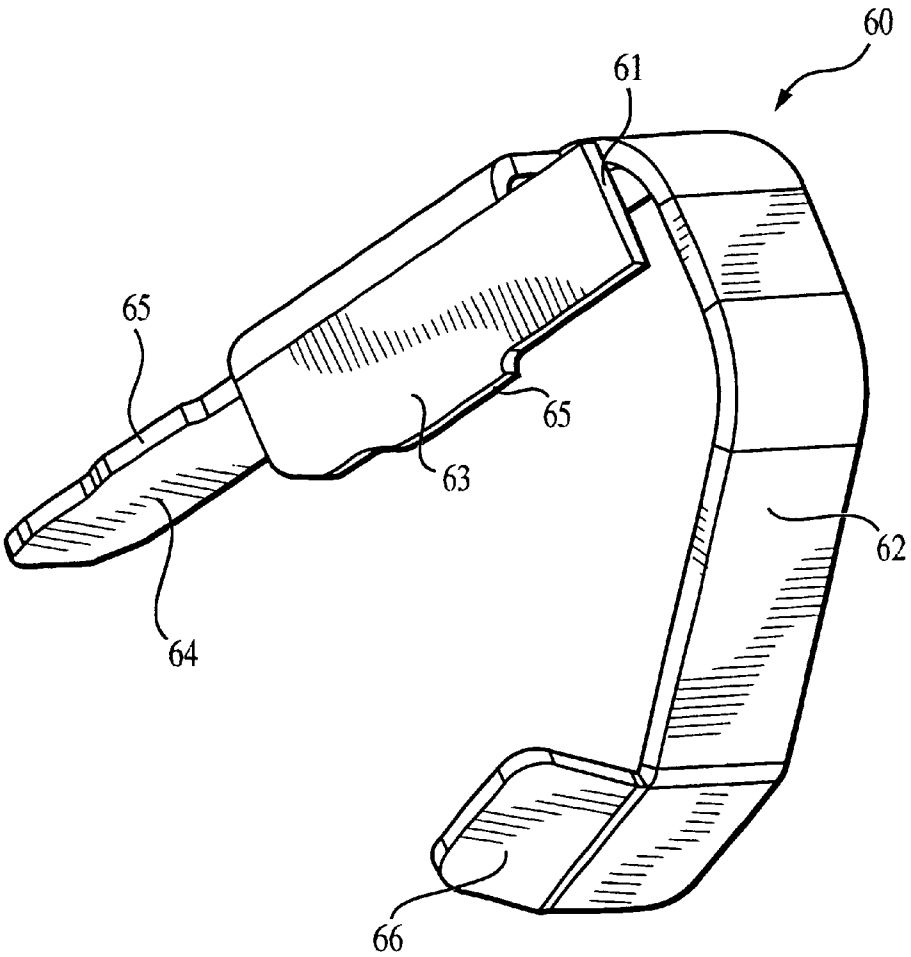
FIG. 12 is an isometric view of an alternative deflection member.
Figure 13:
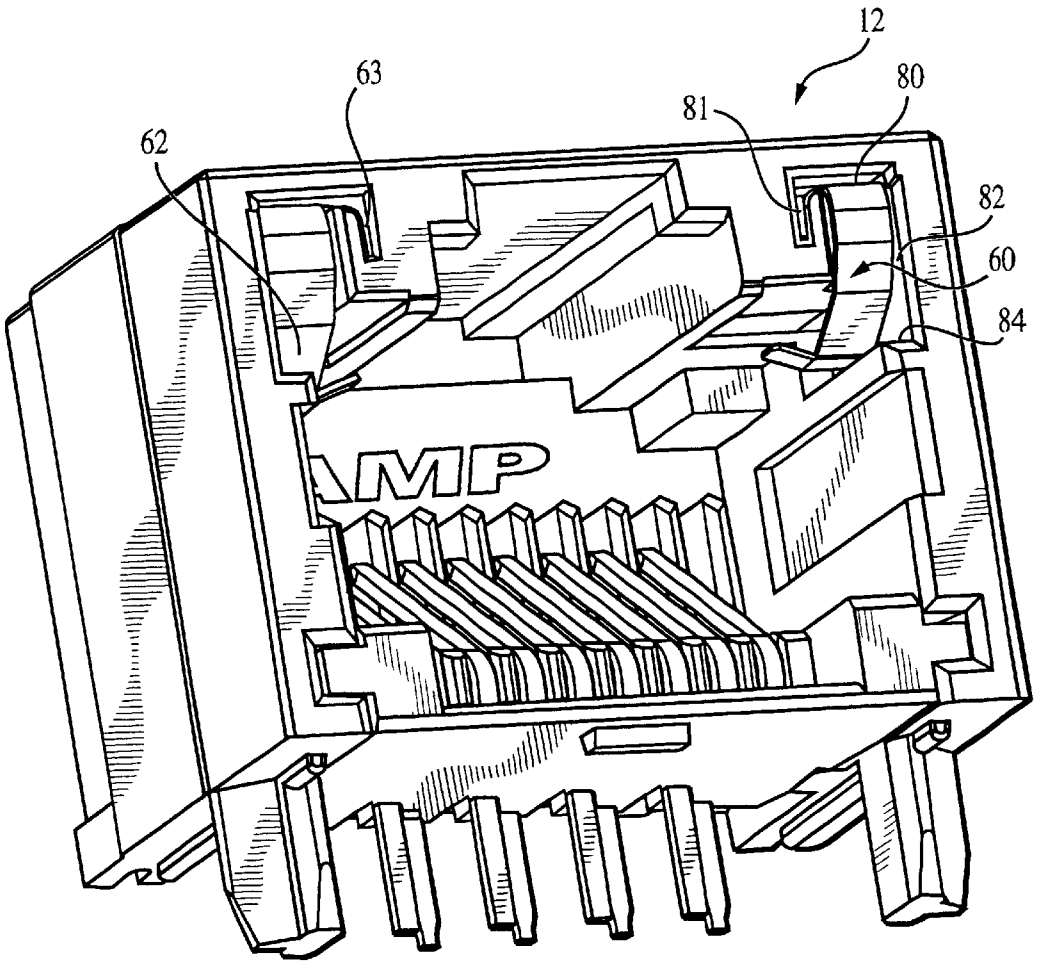
FIG. 13 is an isometric front view of an alternative embodiment of modular jack having the alternative deflection members of FIG. 12 loaded therein.

FIGS. 12 and 13 show an alternative embodiment of the present invention. The alternative deflection member 60 is shown having ramping surface 62 which extends to stopping tabs 66 which again are shown projecting laterally from an end of ramping surface 62 and canted with respect to the end of ramping surface 62. A retention end 64 is also provided on deflection members 60 and an auxiliary retention section 63 is disposed at an angle to retention end 64. Protrusions 65 are located along edges of retention end 64 and auxiliary retention section 63 to firmly secure deflection member 62 in an interference fit within the housing of the modular jack. FIG. 13 shows a modified housing 12 having retention slots 80 and 81, shallow 82 and ledge 84 which define a receiving area for deflection member 60. Retention slot 81 is disposed at an angle to retention slot 80 and is configured to receive auxiliary retention section 63 of deflection member 60. Similar to the deflection member 30 described above, deflection member 60 is front loaded into housing 12 such that retention end 64 is received in retention slot 80, auxiliary retention section 63 is received in retention slot 81, and an end of ramping surface 62 lies along ledge 84. Upon complete insertion of deflection member 60 into housing 12, deflection member 60 becomes fully seated in shallow 82 and protrusions 65 achieve an interference fit within retention slots 80 and 81. By providing a deflection member with an auxiliary retention section set at an angle to a retention end, further security of the deflection member within the housing may be achieved.

The following advantages of the present invention should be apparent from the foregoing disclosure. By providing a modular jack having deflection members with stopping tabs, improper insertion of an RJ-11 type plug into an RJ-45 type jack is avoided. A stamped and formed deflection member provides a low-cost, easily manufacturable device to prevent damage to the RJ-45 type jack. In particular, the simple arcuate-shaped deflection member disclosed herein requires minimal forming to achieve its desired function. Furthermore, by disposing the deflection members in portions of the housing on either side of the latching shoulders 50, sections of the housing which were previously unused in standard modular jacks may now be efficiently used to retain the deflection members. Therefor, the overall profile of the modular jack does not increase with the addition of deflection members. Canting of the stopping tabs prevents the leading edge of an RJ-45 plug from hanging up on the stopping tabs, thereby providing smooth reception of an RJ-45 plug while still preventing insertion of an RJ-11 plug.

In addition, in the rare event that a deflection member is damaged, either or both deflection members may be easily removed and replaced. Also, because minimal modification is made to the modular jack housing to provide deflection member receiving areas, the same housing may also be used in applications where deflection members are unnecessary. In other words, modular jacks may be supplied having the same housing but not having deflection members loaded therein. In this manner, tooling and inventory may be consolidated.

It should be apparent that while RJ-11 and RJ-45 type modular jacks and plugs have been described herein, the principles of the present invention are easily extendable to other receptacle connectors having similarly shaped mating plugs.

The present invention and many of its attendant advantages will be understood from the foregoing description. It is apparent that changes may be made in the form, construction, and arrangement of parts thereof without departing from the spirit of the invention, or sacrificing all of its material advantages. Thus, while several embodiments of the invention have been disclosed, it is to be understood that the invention is not strictly limited to those embodiments but may be otherwise variously embodied and practiced within the scope of the following appended claims.

What is claimed is:

1. A receptacle connector for receiving a mating plug and for blocking a relatively smaller second plug from being received, the receptacle connector comprising:

a housing having a plug-receiving cavity;

terminals mounted in the plug-receiving cavity; and a deflection member formed of a metal sheet material, having a retention section, a ramp surface and a blocking tab, the retention member being mounted in a slot in the housing, the ramp surface extending into the plug receiving cavity and the blocking tab extending laterally from the ramp surface further into the plug-receiving cavity;

wherein, when the mating plug is inserted into the plug-receiving cavity, the ramp surface is engaged and the blocking tab deflects away from the mating plug thereby allowing insertion into the plug-receiving cavity, the second plug is stopped by the blocking tabs, thereby preventing insertion thereof.

2. The receptacle connector of claim 1, wherein two deflection members are provided and are disposed on opposite sides of the plug-receiving cavity.

3. The receptacle connector of claim 2, wherein latching shoulders are provided toward an outer perimeter of the plug-receiving cavity and the slots are disposed in the housing on opposite sides of the latching shoulders.

4. The receptacle connector of claim 1, wherein a recess is provided in the housing opposite the blocking tab, such that upon deflection of the ramp surface, the blocking tab is received in the recess.

5. The receptacle connector of claim 1, wherein the blocking tab is disposed forward of the terminals such that the second plug is blocked prior to engagement with the terminals.

6. The receptacle connector of claim 1, wherein the blocking tab is angled toward a perimeter of the plug-receiving cavity.

7. The receptacle connector of claim 1, wherein the deflection member is arcuate-shaped with the ramp surface bending back toward and opposing the retention section and the blocking tab extending transverse from an end of the ramp surface.

8. The receptacle connector of claim 1, wherein a stub on the retention section of the deflection member provides a pushing surface for loading the deflection member into the housing.

9. A modular jack for receiving a RJ-45 plug and blocking a RJ-11 plug from insertion into the modular jack, the modular jack comprising:

a housing having a plug-receiving cavity and terminals extending into the plug-receiving cavity; and stamped and formed deflection members mounted in the housing on each side of the plug-receiving cavity, each deflection member having a retention section and a ramp surface joined by an arcuate section such that the ramp surface is positioned opposite the retention section, each deflection member further having a blocking tab which extends transversely from an end of the ramp surface; wherein the deflection members are positioned in the housing such that when the RJ-45 plug is inserted into the plug-receiving cavity, a leading edge of the RJ-45 plug engages the ramp surface and deflects the blocking tab away from the plug-receiving cavity, and when the RJ-11 plug is inserted into the plug-receiving cavity, a leading edge of the RJ-11 plug strikes the blocking tab.

10. The modular jack of claim 9, wherein the housing has recesses disposed opposite the blocking tabs which receive the blocking tabs upon deflection of the ramp surfaces.

11. The modular jack of claim 9, wherein the blocking tabs are canted upwardly.

12. The modular jack of claim 9, wherein the housing has latching shoulders for receiving the RJ-45 latch, and the deflection members are disposed in the housing on each side of the latching shoulders.

13. The modular jack of claim 9, wherein the blocking tabs are disposed forward of the terminals.

14. The modular jack of claim 9, wherein the retention section has projections to provide an interference fit within slots in the housing.

15. The modular jack of claim 9, wherein a shield is disposed about the housing.

16. A receptacle connector for receiving a mating plug and for blocking a relatively smaller second plug from being received, the receptacle connector comprising:

a housing having a plug-receiving cavity and a slot disposed proximate the plug receiving cavity;

terminals mounted in the plug-receiving cavity; and a deflection member extending into the plug-receiving cavity, having a retention section disposed in the slot, a ramp surface being joined to the retention section by an arcuate section and a blocking tab extending from the ramp surface;

wherein, when the mating plug is inserted into the plug-receiving cavity, the ramp surface is engaged and the blocking tab deflects away from the mating plug thereby allowing insertion into the plug-receiving cavity, the second plug is stopped by the blocking tabs, thereby preventing insertion thereof.

17. The receptacle connector of claim 16 wherein the blocking tab extends laterally from the ramp surface toward a center of the plug-receiving cavity.

18. The receptacle connector of claim 16, wherein a recess is provided in the housing opposite the blocking tab, such that upon deflection of the ramp surface, the blocking tab is received in the recess.

19. The receptacle connector of claim 16 wherein the blocking tab is disposed forward of the terminals such that the second plug is blocked prior to engagement with the terminals.

20. The receptacle connector of claim 16 wherein the blocking tab is angled toward a perimeter of the plug-receiving cavity.

21. The receptacle connector of claim 16 wherein two deflection members are provided and are disposed on opposite sides of the plug-receiving cavity.

22. The receptacle connector of claim 21 wherein a latching shoulder is provided toward an outer perimeter of the plug-receiving cavity and the slot is disposed in the housing beside the latching shoulder.

* * * * *